US009453366B2

(12) United States Patent
Markham

(10) Patent No.: US 9,453,366 B2
(45) Date of Patent: Sep. 27, 2016

(54) WINDOW ASSEMBLIES INCLUDING BRONZE ELEMENTS

(71) Applicant: OLMOS SCOFIELD, LLC, San Antonio, TX (US)

(72) Inventor: Trevor Markham, San Antonio, TX (US)

(73) Assignee: Olmos Scofield, LLC, San Antonio, TX (US)

( * ) Notice: Subject to any disclaimer, the term of this patent is extended or adjusted under 35 U.S.C. 154(b) by 0 days.

(21) Appl. No.: 14/623,935

(22) Filed: Feb. 17, 2015

(65) Prior Publication Data

US 2015/0191966 A1 Jul. 9, 2015

Related U.S. Application Data

(63) Continuation of application No. 13/838,269, filed on Mar. 15, 2013, now Pat. No. 8,955,270.

(60) Provisional application No. 61/647,796, filed on May 16, 2012.

(51) Int. Cl.

| | |
|---|---|
| ***E06B 3/68*** | (2006.01) |
| ***E06B 3/54*** | (2006.01) |
| ***E06B 1/36*** | (2006.01) |

(Continued)

(52) U.S. Cl.

CPC ..... *E06B 3/68* (2013.01); *E06B 1/366* (2013.01); *E06B 3/04* (2013.01); *E06B 3/12* (2013.01); *E06B 3/5454* (2013.01); *E06B 3/66* (2013.01); *E06B 3/96* (2013.01); *E06B 7/232* (2013.01)

(58) Field of Classification Search

CPC ..... E06B 2003/26312; E06B 2003/26389; E06B 2003/6223; E06B 2003/6226; E06B 3/68; E06B 3/04; E06B 3/96; E06B 3/66; E06B 3/12; E06B 3/5454; E06B 1/366; E06B 7/232

USPC ..... 52/204.69, 204.71, 204.591, 204.61, 52/204.62, 204.593, 204.595, 476, 775

See application file for complete search history.

(56) References Cited

U.S. PATENT DOCUMENTS

| | | | |
|---|---|---|---|
| 2,219,688 | A | 10/1940 | Knudsen |
| 2,288,548 | A | 6/1942 | Peremi et al. |

(Continued)

*Primary Examiner* — James Ference

(74) *Attorney, Agent, or Firm* — Jackson Walker, LLP

(57) ABSTRACT

A window for engagement with a building structure having a window opening, the window is providing a perimeter frame adapted to engage the window opening of the structure. The window has at least one window pane having a window pane perimeter. The window uses multiple perimeter retainer members including an outer perimeter retainer member and an inner perimeter retainer member, the perimeter retainer members typically having opposed substantially flat walls configured to engage the outer pane surface and the inner pane surface, respectively, an perimeter clip member engaging walls. Holding the retainer members are perimeter clip members configured with a first end and a second end, at least the first end adapted to resiliently engage at least one of the perimeter retainer members and a second end to engage the other retainer member so as to maintain the retainers in spaced apart relation with the flat walls thereof flush against walls adjacent the window pane perimeter. There may be resilient sealing members adapted to engage the flat walls of the retainer members to seal the same against the window panes, the perimeter frame adapted to engage the perimeter clip members so as to hold the inner and outer perimeter retainer members fixedly adjacent the frame.

13 Claims, 6 Drawing Sheets

(51) Int. Cl.

| | |
|---|---|
| ***E06B 3/12*** | (2006.01) |
| ***E06B 3/04*** | (2006.01) |
| ***E06B 3/66*** | (2006.01) |
| ***E06B 3/96*** | (2006.01) |
| ***E06B 7/232*** | (2006.01) |

(56) References Cited

U.S. PATENT DOCUMENTS

| | | | | |
|---|---|---|---|---|
| 3,071,215 | A | 1/1963 | Gall | |
| 3,233,381 | A | 2/1966 | Von Wedel | |
| 3,527,011 | A | 9/1970 | Bloom et al. | |
| 4,001,944 | A | 1/1977 | Williams et al. | |
| 4,001,994 | A * | 1/1977 | Williams | E06B 3/6205 52/204.591 |
| 4,106,239 | A * | 8/1978 | Bancroft | E05B 65/0835 160/91 |
| 4,187,657 | A | 2/1980 | Sukolics | |
| 4,221,091 | A * | 9/1980 | Ganse | E06B 9/02 49/61 |
| 4,309,845 | A * | 1/1982 | Schmidt | E06B 7/2309 49/501 |
| 4,428,171 | A | 1/1984 | Harbin | |
| 4,432,179 | A | 2/1984 | Bachmann | |
| 4,447,985 | A | 5/1984 | Weber | |
| 4,495,726 | A | 1/1985 | Lindstrom | |
| 4,614,062 | A | 9/1986 | Sperr | |
| 4,845,911 | A | 7/1989 | Winston et al. | |
| 5,038,537 | A * | 8/1991 | Frambach | E06B 1/325 49/400 |
| 5,044,121 | A | 9/1991 | Harbom et al. | |
| 5,088,255 | A | 2/1992 | Emanuel | |
| 5,214,877 | A | 6/1993 | Kaspar et al. | |
| 5,373,671 | A | 12/1994 | Roth et al. | |
| 5,379,518 | A | 1/1995 | Hopper | |
| 5,481,839 | A | 1/1996 | Lang et al. | |
| 5,570,548 | A | 11/1996 | Hopper | |
| 5,617,684 | A | 4/1997 | Sheath | |
| 5,617,695 | A | 4/1997 | Brimmer | |
| 6,141,925 | A | 11/2000 | Halvorson et al. | |
| 6,182,405 | B1 * | 2/2001 | Lindahl | E06B 1/003 52/202 |
| 6,209,269 | B1 * | 4/2001 | Valderrama | E06B 3/24 52/171.3 |
| 6,438,913 | B1 | 8/2002 | Ishikawa et al. | |
| 6,536,182 | B2 | 3/2003 | France | |
| 6,662,523 | B2 | 12/2003 | Homung et al. | |
| 6,898,914 | B2 | 5/2005 | Folsom et al. | |
| 6,974,518 | B2 | 12/2005 | Homung et al. | |
| 7,036,280 | B2 | 5/2006 | Hogan | |
| 7,040,062 | B2 * | 5/2006 | Emek | E06B 1/02 52/203 |
| 7,065,929 | B2 | 6/2006 | Manzella et al. | |
| 7,765,751 | B2 | 8/2010 | Vukovic et al. | |
| 7,975,432 | B2 * | 7/2011 | Morton | E06B 5/12 49/246 |
| 2002/0121071 | A1 | 9/2002 | Heung-Bin | |
| 2002/0189743 | A1 | 12/2002 | Homung et al. | |
| 2003/0024182 | A1 | 2/2003 | Yeany | |
| 2003/0221381 | A1 | 12/2003 | Ting | |
| 2003/0230034 | A1 | 12/2003 | Lapierre | |
| 2005/0028458 | A1 * | 2/2005 | Rosskamp | E06B 3/24 52/172 |
| 2005/0028460 | A1 * | 2/2005 | Steffek | E06B 3/24 52/204.5 |
| 2005/0034386 | A1 * | 2/2005 | Crandell | E06B 3/24 52/204.5 |
| 2006/0010788 | A1 * | 1/2006 | Nettleton | E06B 1/70 52/58 |
| 2006/0042178 | A1 * | 3/2006 | Hetzel | E06B 1/363 52/204.53 |
| 2006/0101726 | A1 * | 5/2006 | Collins | E06B 1/62 52/58 |
| 2006/0185273 | A1 | 8/2006 | Lathief | |
| 2006/0218875 | A1 | 10/2006 | Homung et al. | |
| 2009/0044467 | A1 | 2/2009 | Krochmal et al. | |
| 2009/0113826 | A1 | 5/2009 | Abdul Lathief | |
| 2009/0139163 | A1 | 6/2009 | Prete et al. | |
| 2009/0139164 | A1 | 6/2009 | Prete et al. | |
| 2009/0139165 | A1 | 6/2009 | Prete et al. | |
| 2010/0031591 | A1 | 2/2010 | Gallagher | |
| 2010/0180504 | A1 | 7/2010 | Kernaghan et al. | |
| 2013/0312343 | A1 * | 11/2013 | Markham | E06B 3/5454 52/204.69 |

* cited by examiner (detail A)

WINDOW ASSEMBLIES INCLUDING BRONZE ELEMENTS

CROSS-REFERENCE TO RELATED APPLICATIONS

This application is a continuation of, and incorporates herein by reference, U.S. patent Ser. No. 13/838,269, filed Mar. 15, 2013, that claims priority to, the benefit of, and incorporates herein by reference U.S. patent Ser. No. 61/647,796 filed May 16, 2012.

BACKGROUND OF INVENTION

The fenestration industry dates from antiquity and mankind has used many methods of securing the openings in buildings that provide light, air and access. After the invention of steel and the methods of readily producing clear glass were developed it became commonplace to enclose openings by means of slender steel framework that held glass panels by means of clips and glazing putty. This allowed for a higher level of shelter to be constructed. Windows made from steel and glass allowed natural light while providing protection from the elements and this paved the way to control indoor temperature. The invention of air conditioning induced a further need to control air infiltration, radiant energy and thermal transfer and consequently steel window production slowly gave way to more energy efficient methods of construction. This transition significantly altered the architectural style that had been established with the low profile steel windows. The applicants present invention allows for the architectural style established with the narrow sight lines of steel windows with a maintenance free window that has the thermal performance required in modern construction.

BRIEF DESCRIPTION OF THE INVENTION

Applicant has created a window typically constructed primarily from bronze and brass extrusions with a profile similar to the old fashioned steel windows, that can be dry glazed and with a design that helps reduce thermal transfer through the frame and provides for the use of monolithic or insulated glass. This window system, with the unique single or double glass retainer attachment, as well as novel methods of securing the units into a building structure, allows for integration into the modern building envelope, providing the necessary barrier against moisture, air infiltration and solar energy while maintaining the distinctive architectural style of a bygone era.

DETAILED DESCRIPTION OF PREFERRED EMBODIMENT

Figure 1:
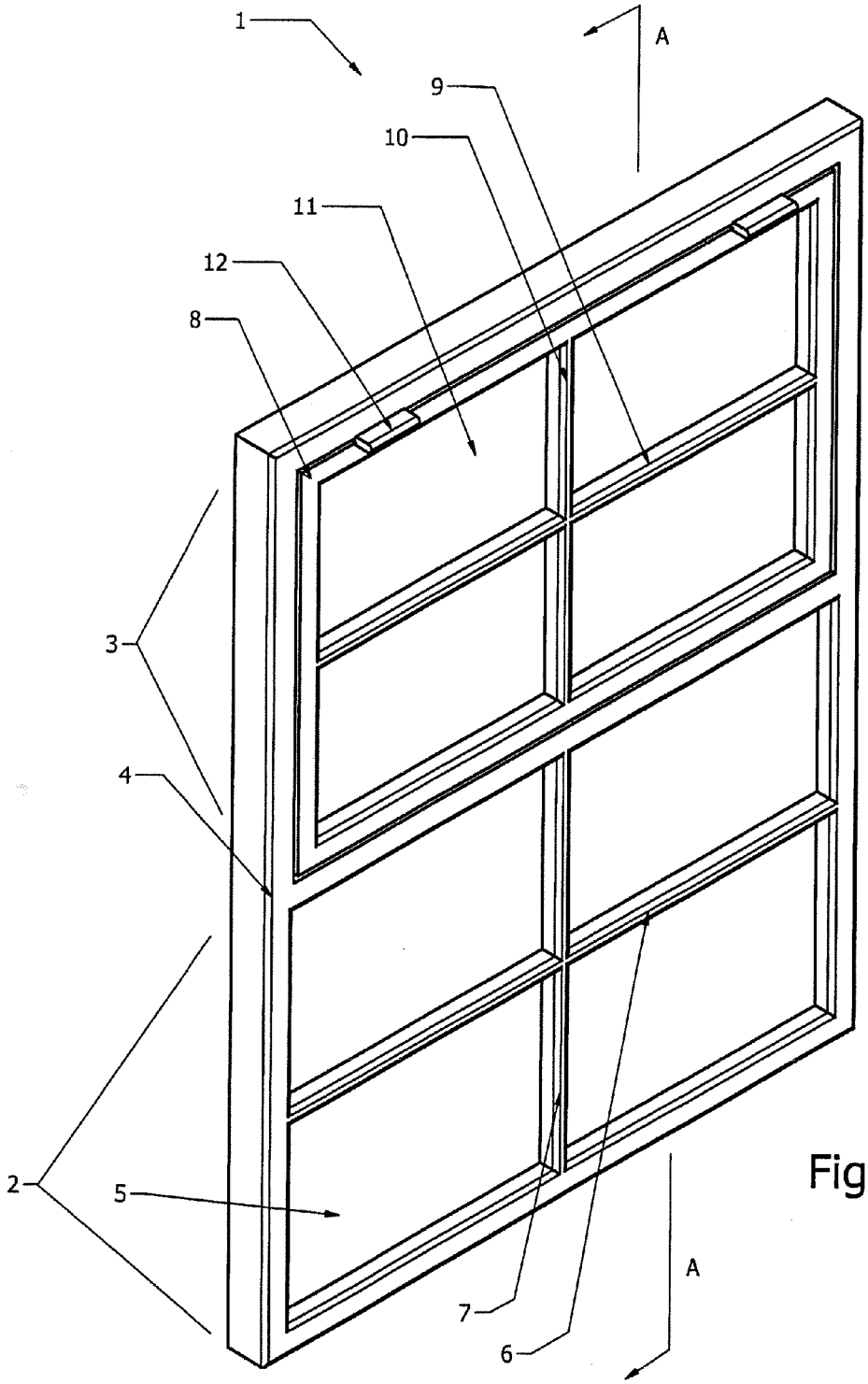
FIG. 1 is a perspective view of a typical window including an operational and fixed glass portion. The cutaway section line a-a is the vantage point of the other figures.
Figures 2A, 2B, 2C, 2D, 2E:
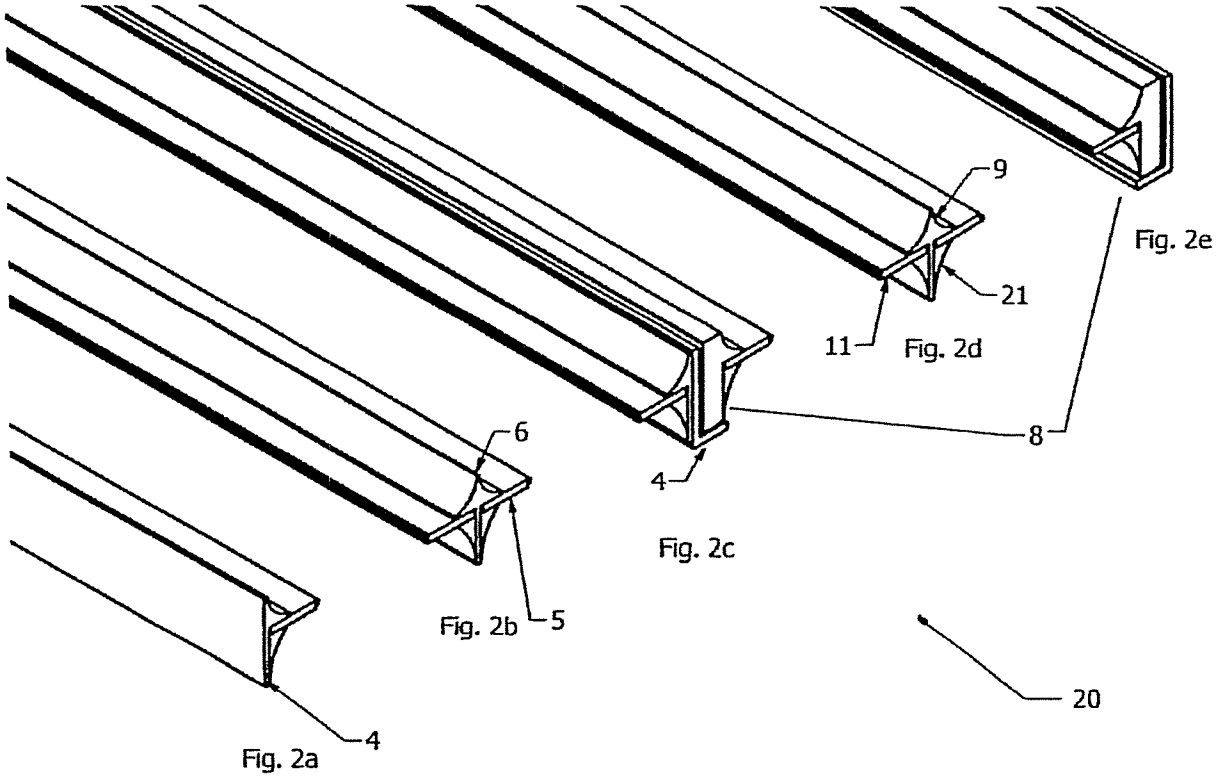
Figure 2a-2e Prior Art
FIG. 2*a* through 2*e* portray a cutaway section views of a traditional prior art steel window that was regularly glazed with a single layer of glass

Turning to FIG. 1, we see Mulled Window (1) comprised of a Fixed Window (2) and Operating Window (3), joined by common Outside Frame (4). Typically, Fixed Glass (5) is set directly into Frame (4) of Fixed Window (2), although interrupted by Fixed Horizontal Muntin Bar (6) and Vertical Fixed Muntin Bar (7). Active Sash (8) is operably connected to Outside Frame (4) by means of Hinge (12), and supports Horizontal Active Muntin Bar (9) and Vertical Active Muntin Bar (10), which together holds the Sash Glass (11). Of course there are many different configurations that windows can be arranged in, and this drawing is to illustrate the basic parts of the windows in discussion.

In FIGS. 2*a*-2*e*, we see the steel cross section (20) which is a typical detail of existing art. More specifically we see steel cross section (20) has many of the same components as the mulled window (1) of FIG. 1, including the outside frame (4), fixed glass (5), horizontal fixed muntin bar (6), active sash (8), horizontal active muntin bar (9) and sash glass (11). Further we see fixed glass (5) and sash glass (11) are single pane glass and are secured with glazing putty (21) which is inserted to seal the edges. Also of note is that the horizontal fixed muntin bars (6), outside frame (4), horizontal active muntin bar (9) and active sash (8) are all constructed of monolithic pieces of metal which readily transmit heat.

Figure 3A:
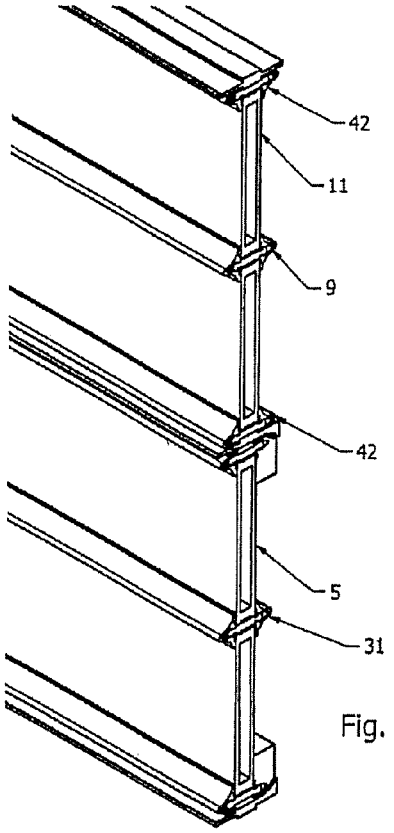
FIGS. 3*a*-3*c* are cutaway section views of applicant's present invention and displays the unique double glass retainers and the dry glazing seal details.
Figure 3C:
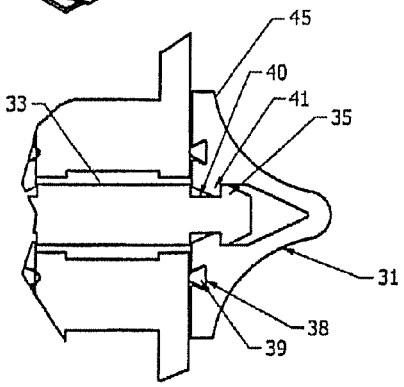
Figure 3B:
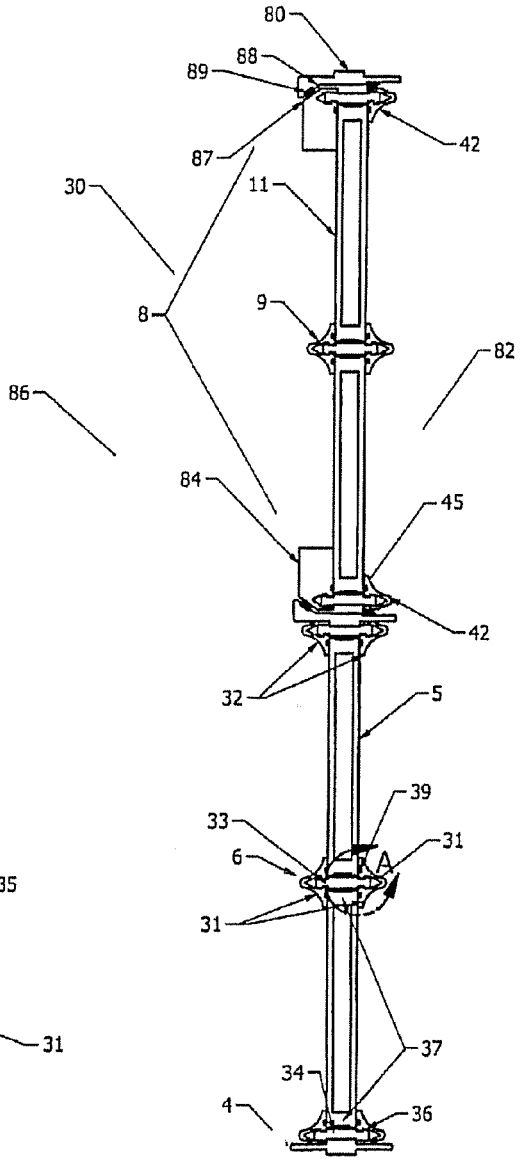

FIGS. 3*a*, 3*b* and 3*c* details bronze cross section (30), which is a typical detail of applicant's present invention. In the bronze cross section (30) there are also the components listed in the mulled window (1) of FIG. 1, including the outside frame (4), fixed glass (5), horizontal fixed muntin bar (6), active sash (8), horizontal active muntin bar (9) and sash glass (11). A distinguishing feature of the applicant's present invention is the double muntin snap joints (35) and perimeter snap joints (36) which have a snap attachment channel (40) and engage corresponding attachment clip ridge (41) on the arm extension (45) of the snap joints (35) and (36), the attachment clip ridge (41) and snap attachment channel (40) are formed by contouring the wall of double muntin retainers (31) and double perimeter retainers (32) and muntin base (33) and perimeter base (34) respectively. So as the window is constructed, the double muntin retainers (31) and double perimeter retainers (32) are affixed to the muntin base (33) and perimeter base (34), respectively, and are fastened together at muntin snap joints (35) and perimeter snap joints (36), forming a glazing channel (37) to support the glass. It will be noted that glazing channel can optionally provide for sealant groove (38) to house glazing gasket (39) which eliminates the need for glass to be set in a wet bed of sealant, and replaces the glazing putty (21) FIG. 2 in the prior art. It is also noted that the fixed glass (5) and sash glass (11) are double pane, or insulated glass, although it could be constructed with single pane glass in the same manner. The muntin base (33) and perimeter base (34) are typically constructed of a non-metallic material or different density metal coated so as to reduce thermal conductivity, and consequently significantly increasing the insulating properties of the window. Further it can be seen on bronze cross section (30) that outside frame (4) is comprised of active sash perimeter FRAME (80) at Operating Window (3) for operable attachment to Active Sash (8). Further, the geometry of Active Sash (8) allows for uniformity between Active Perimeter Retainer (42) and the double Perimeter Retainers (32) when viewed from Exterior Face (82). Support Frame (84) can be seen on Interior Face (86) and provides strength and a place to mount commercially available locking hardware. Outside Edge (87) of Active Sash Perimeter Frame (80) is closely contoured to correspond with Inside Edge (88) of Active Sash Perimeter Frame (80), and Weather Stripping (89) is used to seal between Active Sash (8) and Active Sash Perimeter Frame (80).

Figures 4A, 4B:
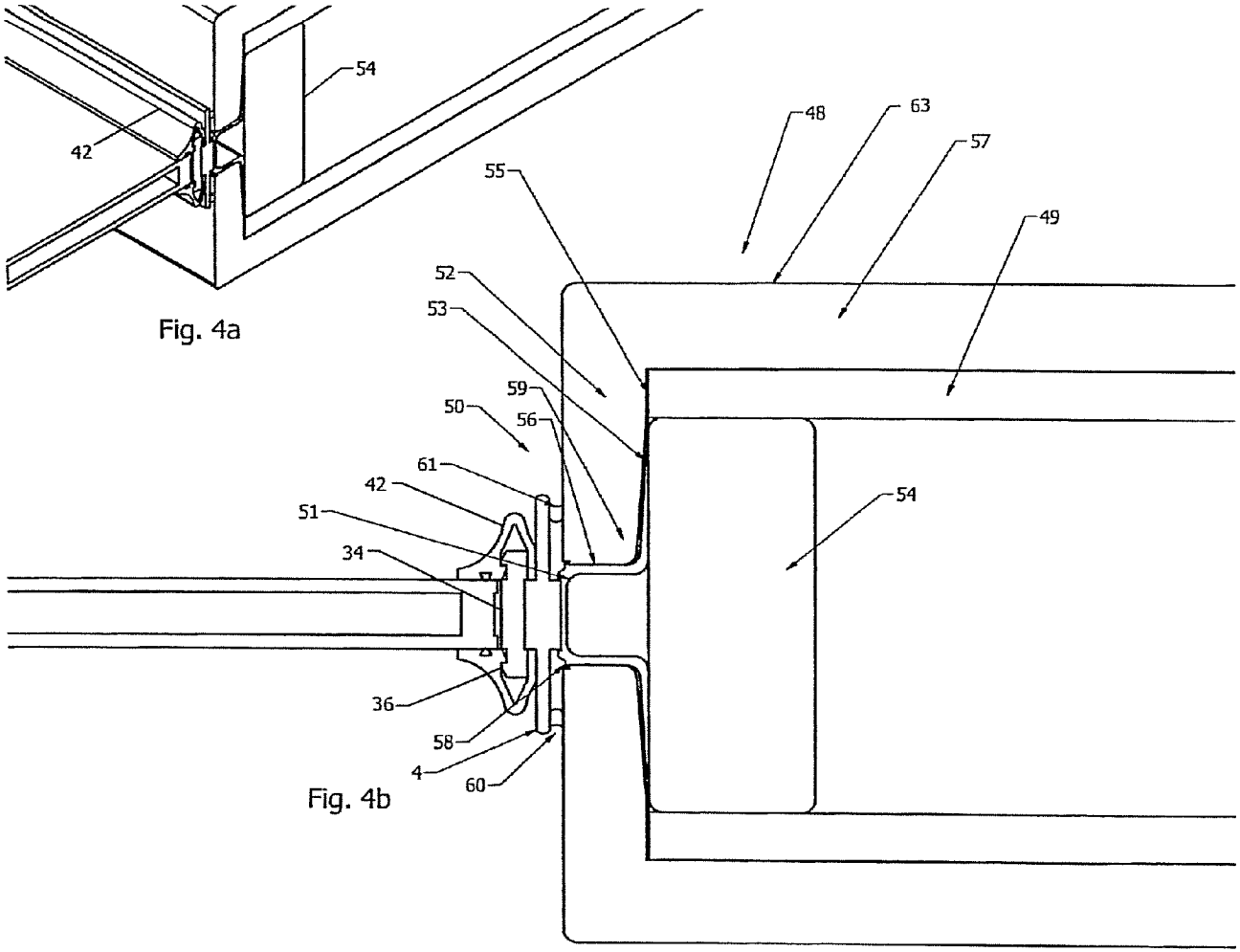
FIGS. 4*a* and 4*b* are cutaway perimeter detail sections of the unique plaster flange attachment method of applicant's present invention that allows for the antique architectural style of setting the windows in the center of a thick masonry covered wall and yet still provide for the moisture barrier required in modern construction.

FIGS. 4*a* and 4*b*, detail Fixed Plaster Flange (50) a cut-away section of Outside Frame (4) with the unique Plaster Flange (51) attached to outside frame (4). It is noted that Outward Edge (53) is affixed to the Building Structure (54) and provides a surface for Waterproofing Membrane (55) to seal against. Plaster Pocket (56) allows Reinforced Plaster (57) sufficient space to be structurally sound while Trowel Guide (58) forms a utility point to guide the masons trowel as the plaster is applied to the wall. Once applied, Reinforced Plaster (57) forms one side of the Caulk Channel (60) where Flexible Caulk (61) is applied to form an additional seal against moisture penetration. Moisture peculation thru Reinforced Plaster (57) is stopped by Separator Channel (62), allowing the window to be seamlessly part of the building moisture barrier system needed in modern construction for the maintenance of Indoor Air Quality (IAQ).

Figures 5A, 5B:
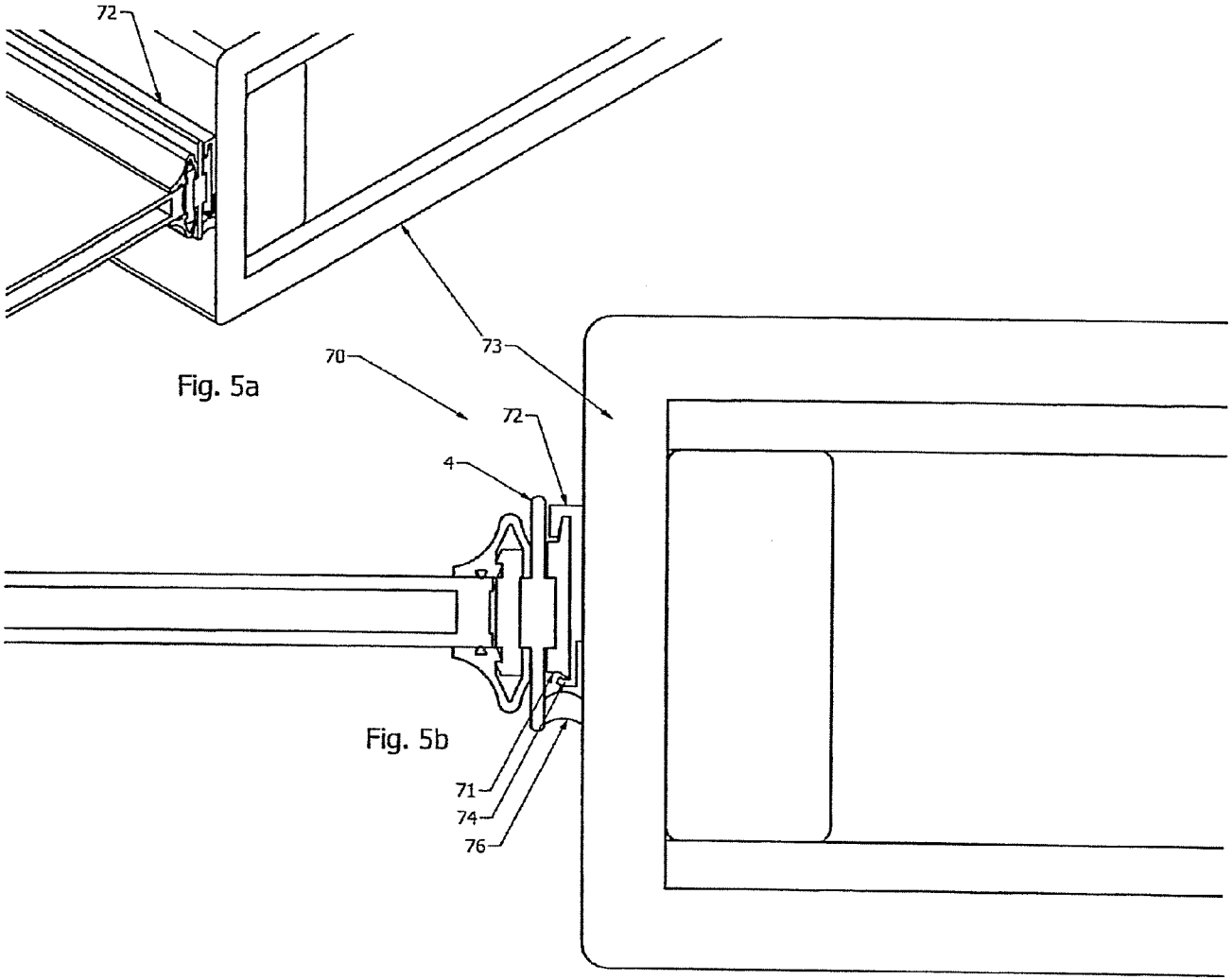
FIGS. 5*a* and 5*b* shows cutaway perimeter detail sections of an alternate attachment method of applicant's present invention that allows for retrofitting existing steel windows.

FIGS. 5*a* and 5*b*, Replacement Frame (70) is a cut-away section of Outside Frame (4) with alternate Remodel Flange (71). In practice, Setting Block (72) is fastened to Existing Wall (73) and Remodel Flange (71) is connected the Setting Block (72) by means of Clip (74). Frame is sealed into Existing Wall (73) by means of Flexible Caulk (76).

Figure 6:
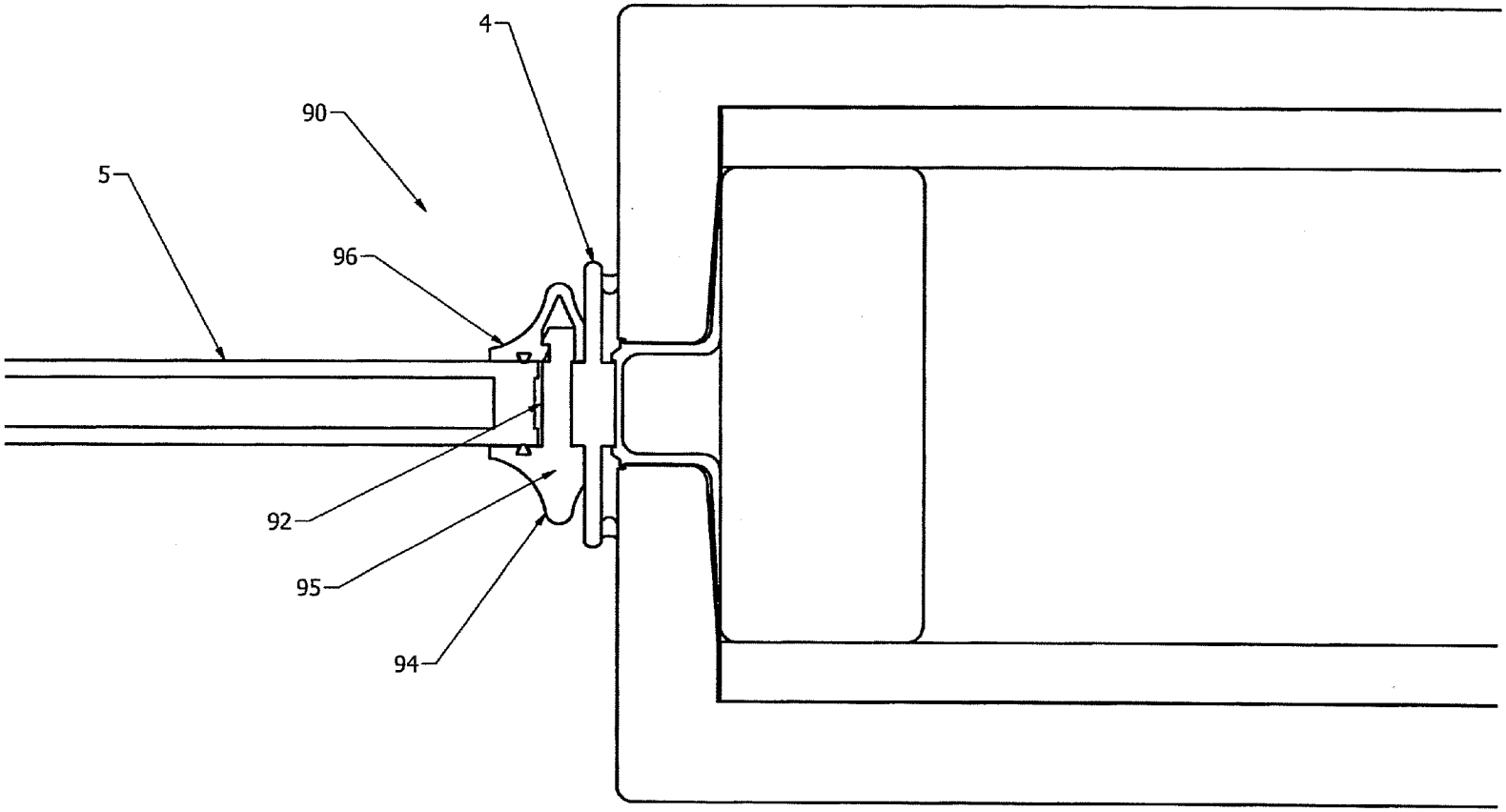
FIG. 6 is a top view cutaway perimeter detail section of a stationary window where the perimeter base is combined into a single piece with one of the retainers, allowing for increased manufacturing efficiencies.

FIG. 6 is a cut-away section of the Alternate Bronze Frame (90), which is an alternate design detail of applicant's present invention. The Alternate Bronze Frame (90) includes some of the components listed in the Mulled Window (1) of FIG. 1, including the Outside Frame (4), Fixed Glass (5). The distinguishing feature of the applicant's alternate configuration is the combination of Alternate Perimeter Base (92) and Inside Perimeter Stop (94) into a one piece Perimeter Retainer Base (95). Perimeter Retainer (96) is then applied to Perimeter Retainer Base (95) to secure the glass. The utility of this can be applied to Active Sash (8) and Muntin Bar (6) on FIG. 3.

Although the invention has been described with reference to a specific embodiment, the description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A window assembly for engagement with a building structure having a window opening comprising multiple members including a pair of vertical spaced apart frame members and siding having a thickness of "T", the window assembly comprising:

a perimeter frame fixed in relation to a building structure;

a window, wherein the window has at least one window pane having a window pane perimeter, an outer pane surface, and an inner pane surface;

multiple perimeter retainer members, each of the multiple perimeter retainer members including an outer perimeter retainer member and an inner perimeter retainer member, each of the outer and inner perimeter retainer members having opposed substantially flat walls configured to engage the outer pane surface and the inner pane surface, respectively;

a perimeter member adapted to hold the window pane to the perimeter frame so as to maintain the perimeter retainer members in a spaced apart relation with the substantially flat walls thereof flush against the window pane perimeter;

wherein the fixed perimeter frame is adapted to slideably engage the perimeter retainer members and perimeter member so as to hold the inner and outer perimeter retainer members fixedly in place; and a mounting flange fixed to a vertical frame member of the pair of vertical spaced apart frame members and fixed to the perimeter frame, the mounting flange adapted to allow the window to slide with respect to the perimeter frame and position the window set in from a face of a vertical stationary support wall of a building structure, the fixed mounting flange providing a surface to apply a waterproof membrane to seal the window, the mounting flange having a first portion, a third portion for engaging the perimeter frame and a second portion, spaced inward with respect to the first and third portions and between the first and third portions, the fixed mounting flange for engaging at least part of the perimeter frame and a portion of one or more of the multiple perimeter retainer members of the window opening;

wherein the second portion is raised with respect to the first and third portions at a distance equal to "T".

2. The window of claim 1, wherein at least one of the multiple perimeter retainer members is constructed of a bronze material.

3. The window of claim 1, wherein the perimeter member includes a clip member.

4. The window of claim 1, further including muntin members.

5. The window of claim 1, wherein the panes are a multiplicity of panes and further comprising muntin members, the muntin members each comprising an outer muntin retainer member and an inner muntin retainer member, the muntin retainer members each having a pair of laterally spaced apart, opposed, substantially flat facing walls configured to engage a perimeter of a first pane of the multiplicity of panes and a perimeter of a second adjacent pane of the multiplicity of panes, the outer and inner muntin retainer members each including muntin clip engaging walls centrally located between the pair of laterally spaced facing walls;

a muntin clip member having a first end and a second end, at least the first end adapted to resiliently engage the muntin clip engaging walls of one of the muntin retainer members and the second end to engage the other of the muntin retainer members so as to maintain the flat facing walls snugly against the inner and outer pane surfaces of the adjacent panes; and a plurality of resilient sealing members adapted to engage the flat walls of the retainer members to seal the retainer members against the perimeters of adjacent window panes.

6. The window of claim 1, wherein the fixed mounting flange includes a trowel guide.

7. The window of claim 1, further including a resilient sealing member adapted to engage the substantially flat walls of the retainer members to seal the retainer members against the window pane.

8. The window of claim 1, wherein the fixed perimeter frame and flange are dimensioned to accept a building siding material between the window and at least one of the multiple members of the window opening.

9. The window of claim 8, wherein at least one of the multiple perimeter retainer members is constructed of a bronze material.

10. The window of claim 8, wherein the perimeter member includes a clip member.

11. The window of claim 8, further including muntin members.

12. The window of claim 8, further including a resilient sealing member adapted to engage the substantially flat walls of the retainer members to seal the retainer members against the window pane.

13. The window of claim 8, wherein the building siding material is stucco.

* * * * *